US006765462B2

(12) United States Patent
Noguchi

(10) Patent No.: US 6,765,462 B2
(45) Date of Patent: Jul. 20, 2004

(54) RELAY

(75) Inventor: Takashi Noguchi, Kyoto (JP)

(73) Assignee: Omron Corporation, Kyoto (JP)

( * ) Notice: Subject to any disclaimer, the term of this patent is extended or adjusted under 35 U.S.C. 154(b) by 0 days.

(21) Appl. No.: 10/093,102

(22) Filed: Mar. 8, 2002

(65) Prior Publication Data

US 2002/0130741 A1 Sep. 19, 2002

(30) Foreign Application Priority Data

Mar. 9, 2001 (JP) ..... 2001/067095
Apr. 9, 2001 (JP) ..... 2001/110023

(51) Int. Cl.[7] ..... H01H 67/02
(52) U.S. Cl. ..... 335/128; 335/78; 335/83
(58) Field of Search ..... 335/78–86, 124, 335/128, 202

(56) References Cited

U.S. PATENT DOCUMENTS 5,148,136 A * 9/1992 Kidd ..... 335/78
6,111,487 A * 8/2000 Hoffmann et al. ..... 335/80
6,252,479 B1 * 6/2001 Kern ..... 335/80

* cited by examiner

*Primary Examiner*—Lincoln Donovan
(74) *Attorney, Agent, or Firm*—Morrison & Foerster LLP

(57) ABSTRACT

An object of the present invention is to provide a relay in which an external lead-out terminal portion can be arranged in an optional position so as to constitute an in-line terminal while forming a base and performing a sealing operation easily. Horizontal portions are formed by bending terminal portions of coil terminals of an electromagnet block, and the horizontal portions are laid along the under face of a base to arrange the terminal portions and other terminal portions in a line.

4 Claims, 9 Drawing Sheets

(A)

(B)

(A)

(B)

RELAY

BACKGROUND OF THE INVENTION

1. Field of the Invention

The present invention relates to a relay, and more particularly to a terminal structure of a relay.

2. Description of the Background Art

Conventionally, in the case of constituting a relay, in particular, a relay which is a thin type and has a small floor area, an electromagnet block and a contact mechanism portion are sometimes arranged adjacenct to each other on the top face of a base. In such a case, a substantially Z-shaped insulating wall when viewed from above is arranged between the electromagnet block and the terminal mechanism portion for the purpose of increasing a creepage distance for insulation to enhance the insulating property.

In the above-mentioned arrangement, there is a case where the electromagnet block and the contact mechanism portion must be assembled not from above the base, but from opposing side directions of the base independently from an assembling standpoint. In such a case, sometimes an external lead-out terminal portion of a coil terminal constituting the electromagnet block and an external lead-out terminal portion of a contact terminal constituting the contact mechanism portion are attempted to be arranged in a line to form an in-line terminal structure. When this is attempted to from the in-line structure, for example, by inserting a contact terminal into a shallow groove provided in one end side of the opposing sides of the base, it is necessary to arrange the external lead-out terminal portion of the coil terminal in alignment with the external lead-out terminal portion of the contact terminal on the same line, so that a deep groove to which the coil terminal is inserted has to be formed on the other side of the base. Therefore, since the strength of the base deteriorates and the opening area of the groove becomes large, there has been a problem in that a large amount of a sealing material is required for the sealing operation after assembling, and the sealing operation becomes vexatious.

SUMMARY OF THE INVENTION

The present invention is made in view of the above problem, and an object of the present invention is to provide a relay, particularly a thin relay, in which an external lead-out terminal portion can be arranged at an optional position so as to constitute an in-line terminal structure while forming a base and performing a sealing operation easily.

In order to achieve the above mentioned objective, there is provided a relay according to the present invention having an electromagnet block and a contact mechanism portion arranged on the top face of a base, and a substantially Z-shaped insulating wall, when viewed from above, arranged between the electromagnetic block and the contact mechanism portion, the electromagnetic block and the contact mechanism portion being assembled from opposite side directions of the base, wherein at least one of an external lead-out terminal portion of a contact terminal of the contact mechanism portion and an external lead-out terminal portion of a coil terminal of the electromagnet block is bent to form a horizontal portion, and the horizontal portion is laid along the under face of the base to arrange the external lead-out terminal portions in a line.

Therefore, according to the present invention, it is possible to arrange the external lead-out terminal portion of at least one of the contact terminal and the coil terminal in an optional position, thereby obtaining a desired terminal arrangement structure. Thus, even in use of a relay in which an electromagnetic block and a contact mechanism portion are assembled from opposite side directions of a base, it is possible to obtain an in-line structure without forming a deep fitting groove in a side end face of the base. As a result, there is an effect such that the base is easily formed while a sealing operation is easily performed after assembling.

Further, a binding portion of the coil terminal may be arranged so as to neighbor a movable iron piece adjacent to the other side of an iron core.

According to this embodiment, the movable iron piece corresponding to an attraction face neighbors the coil terminal at the other side of the iron core around which the coil is wound. Therefore there is an effect where a dead space caused by wounding the coil can be effectively used, the size of the device can be decreased, and a desired magnetomotive force can be obtained.

Furthermore, a guide groove, to which the horizontal portion of the external lead-out terminal portion can be fitted, may be formed in the under face of the base.

According to this embodiment, it is possible to obtain a high assembling accuracy by fitting the horizontal portion of the above-mentioned terminal portion into the guide groove. In particular, if the depth of the guide groove is same as the plate thickness of the terminal portion, the under face of the base becomes flush with the terminal portion. Therefore, even when the sealing material is implanted to the bottom face of the base, the sealing can be performed by using a small amount of the sealing material.

Furthermore, a step portion may be formed in of the coil terminal constituting the electromagnetic block so that an upper portion of the coil terminal is arranged on the inside the base.

According to this embodiment, the upper portion of the coil terminal is positioned inside the base. Therefore, even if a case is fitted to the base, there is an effect where the upper portion of the coil terminal does not come into contact with the case, thereby improving the assembling property.

The foregoing and other objects, features, aspects and advantages of the present invention will become more apparent from the following detailed description of the present invention when taken in conjunction with the accompanying drawings.

DESCRIPTION OF THE PREFERRED EMBODIMENT

Figure 1:
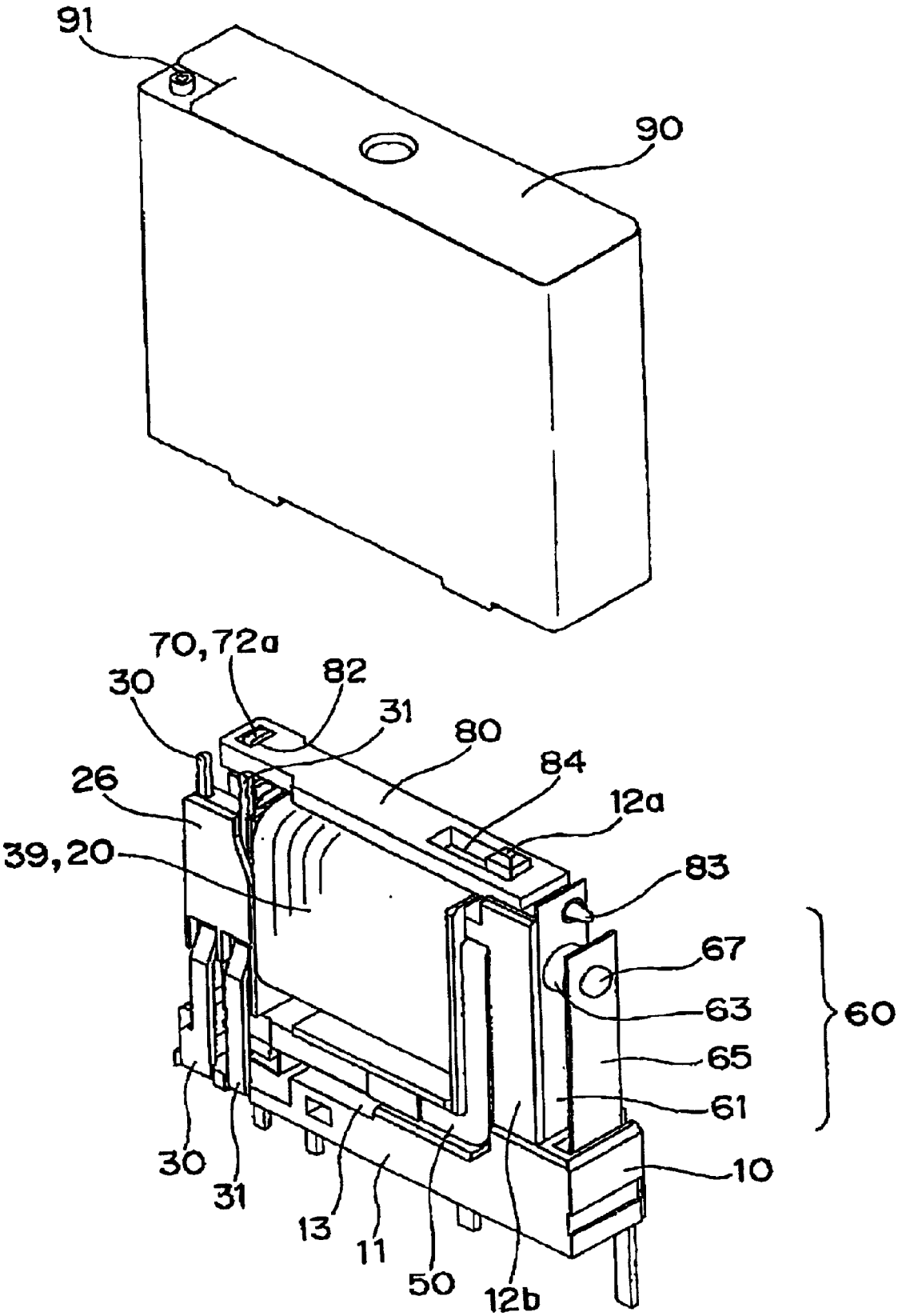
FIG. 1 is an exploded perspective view showing an embodiment of a relay according to the present invention.
Figure 2:
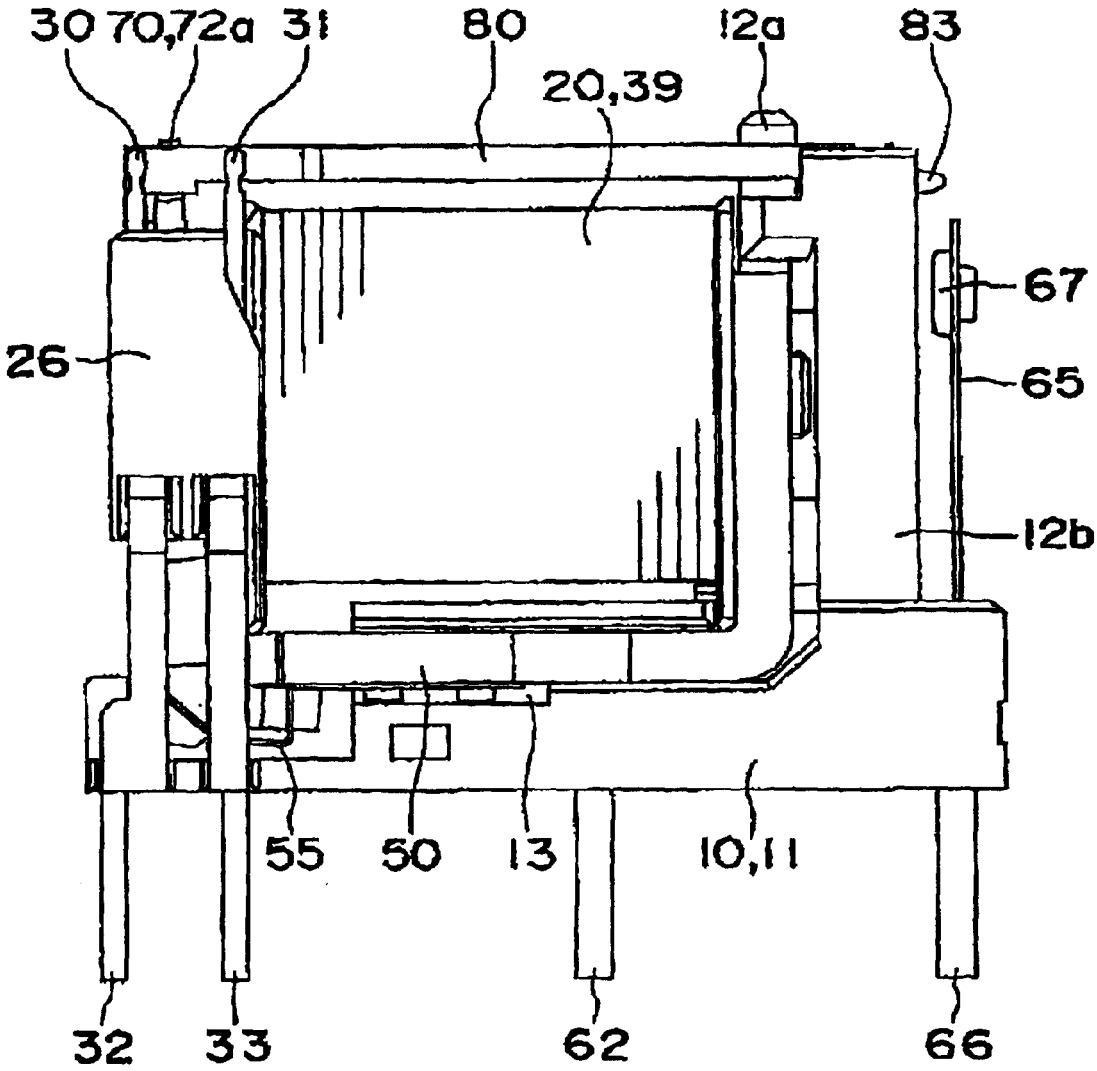
FIG. 2 is a front view of a relay main body shown in FIG. 1.
Figure 3:
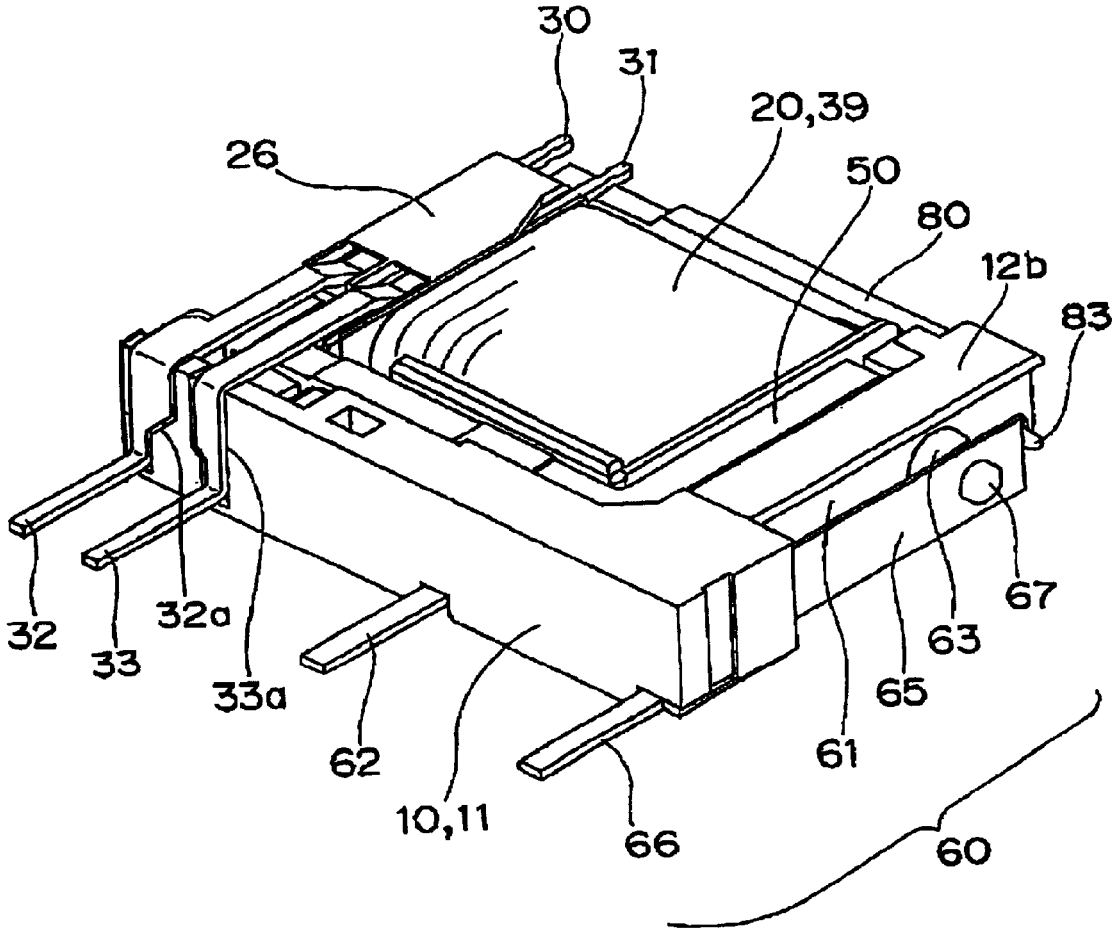
FIG. 3 is a perspective view of the relay main body taken from an angle different from that in FIG. 2.

An embodiment of the present invention will be described with reference to FIGS. 1 to 9.

The embodiment according to the present invention is generally constituted by a base 10, an electromagnet block 20, a contact mechanism portion 60, a movable iron piece 70, a card 80 and a case 90.

Figure 4:
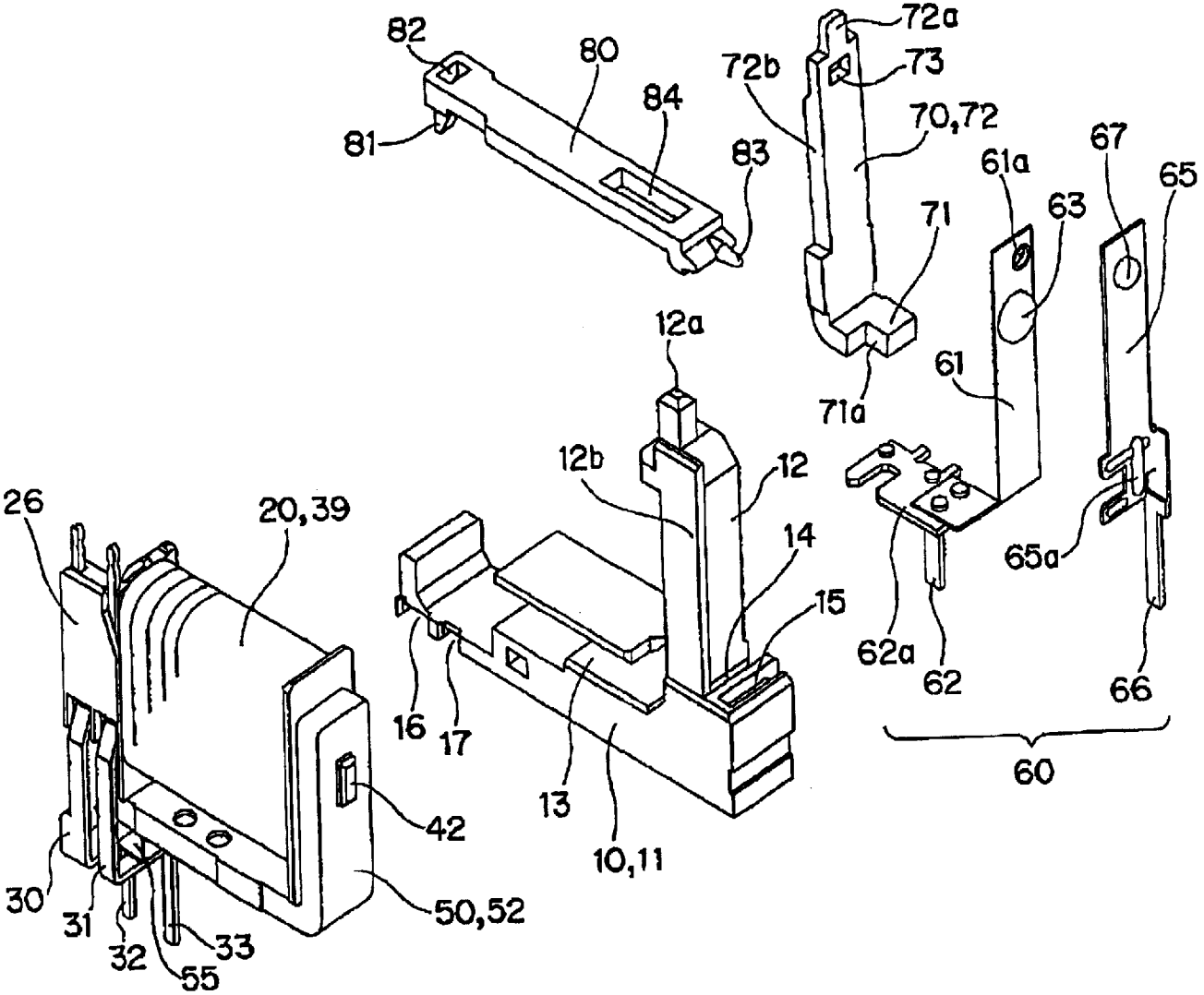
FIG. 4 is an exploded perspective view of the relay main body shown in FIG. 1.

As shown in FIG. 4, the base 10 is provided and integrated with an insulation support 12 adjacent to one end portion of a base main body 11. The insulation support 12 includes a protrusion 12*a* provided on an upper end thereof, and insulating walls 12*b* and 12*c* (referring to FIGS. 2 and 9) extending in opposite directions from opposite side faces of the Insulation support 12. An attachment hollow 13 for assembling the electromagnetic block 20 is formed in an upper face of the base main body 11 positioned on one side of the base portion of the insulation support 12. On the other hand, pressing slits 14 and 15 to which a movable contact piece 61 and a fixed contact piece 65 are pressed respectively, are formed in the base portion on the other side of the insulation support 12. Further, guide grooves 16 and 17 into which horizontal portions 32*a* and 33*a* of coil terminals 30 and 31, described below, are fitted are formed in the under face of the base main body 11.

Figure 5:
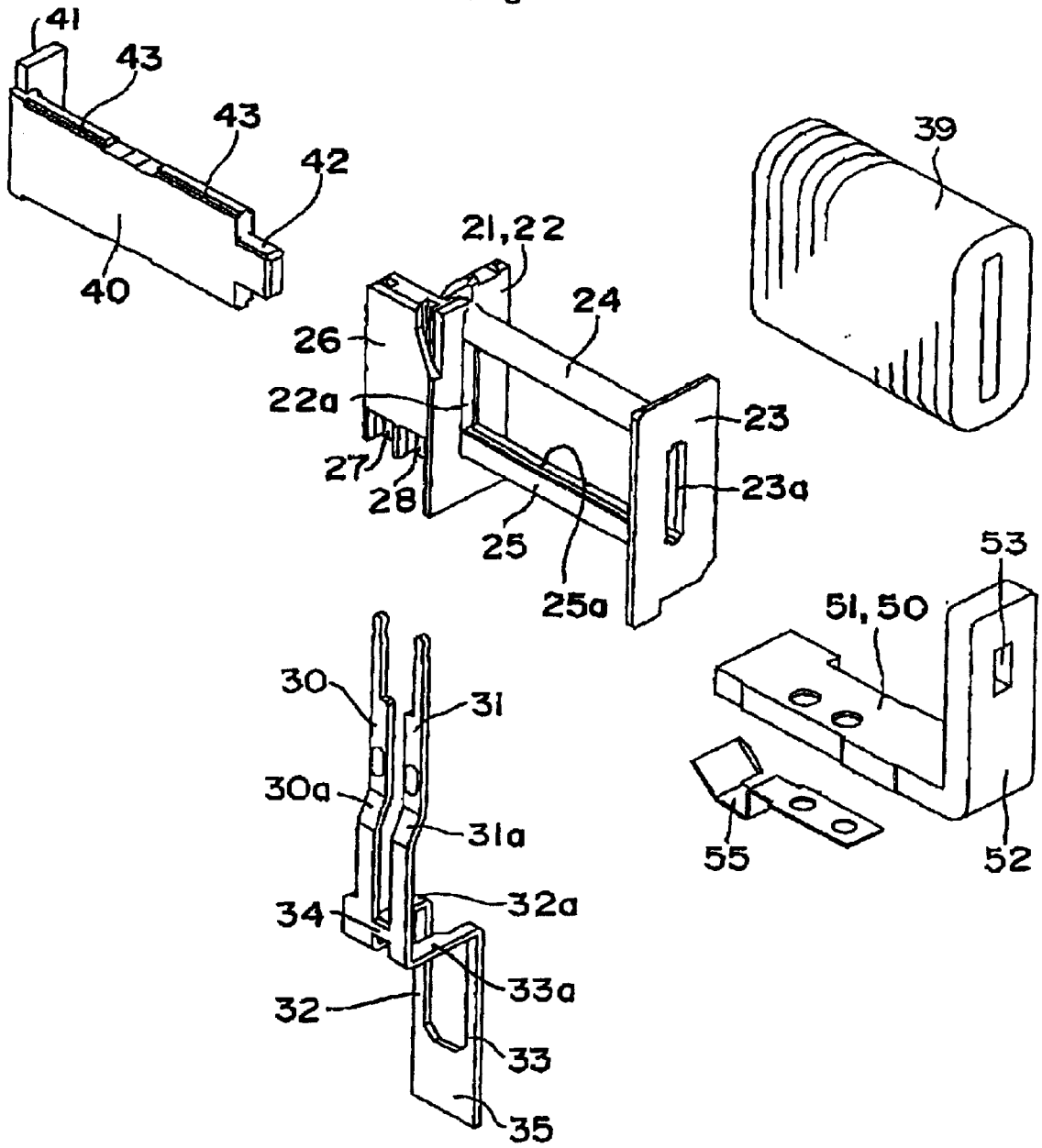
FIG. 5 is a perspective view of an electromagnet block shown in FIG. 4.

As shown in FIG. 5, the electromagnet block 20 is constituted by a spool 21, a pair of coil terminals 30 and 31, a coil 39, an iron core 40 and a yoke 50.

The spool 21 is a resin molded product in which a pair of winding portions 24 and 25 are extended above and below between a pair of flanges 22 and 23. The flanges 22 and 23 are respectively provided with angular holes 22*a* and 23*a* on the same axis. Guide grooves 24*a* and 25*a* for guiding the iron core 40 are formed in the opposite faces of the winding portions 24 and 25 respectively. Furthermore, an attachment board 26 into which the coil terminals 30 and 31, described below, are pressed are extended to the flange 22 of the spool 21. Pressing holes 27 and 28 into which the two coil terminals 30 and 31 are pressed are formed in the attachment board 26.

Figure 6A:
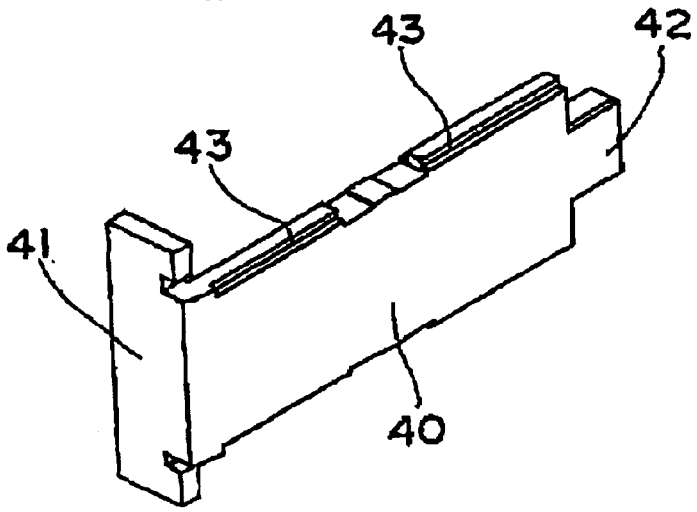
FIG. 6A is an enlarged perspective view of an iron core shown in FIG. 4.
Figure 6B:
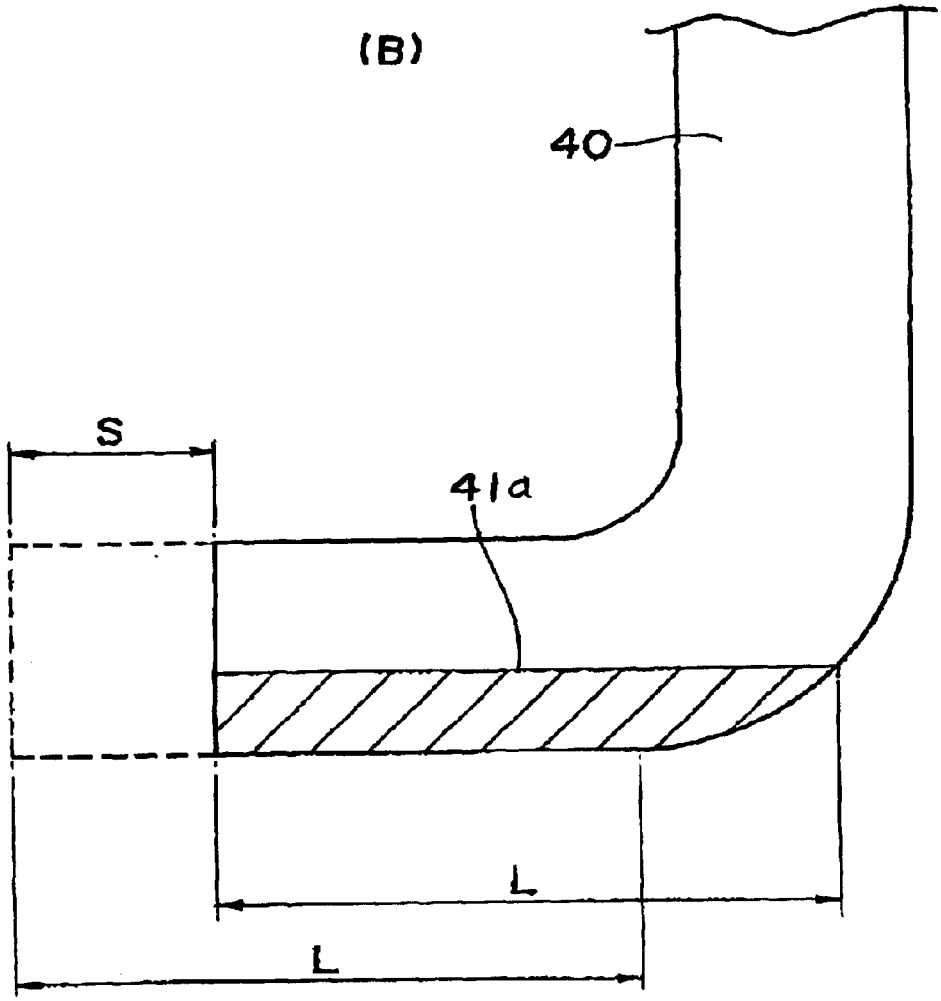
FIG. 6B is an enlarged plan view of the main part of the iron core.

As shown in FIG. 6(A), the iron core 40 is made of a plate-like magnetic material having one end portion which is wide. The one end portion is bent to serve as a magnetic pole 41. An attraction face of the magnetic pole 41 is subjected to a rolling treatment or a shaving treatment, thereby widening an area of the attraction face. Thus, according to this embodiment, as shown n FIG. 6(B), not only the width L of the area of the attraction face 41*a* can be secured, but also being the magnetic pole 41 can be shortened by the length S by only to a bending treatment subjected, then a much thinner relay can be obtained. Furthermore, guide projections 43 and 44 for facilitating and assuring insertion into the spool 21 are provided on upper and lower end faces of the iron core 40. However, the intermediate portion of each of the guide projections 43 and 44 is discontinuous in order to decrease friction resistance upon insertion.

As shown in FIG. 5, the yoke 50 is a magnetic member which is bent into a substantially L-shaped magnetic material, and a bent hinge spring 55 is squeeze-fitted on to a protrusion provided on the under face of the horizontal portion 51 of the yoke 50. On the other hand, a vertical portion 52 of the yoke 50 is provided with a squeeze hole 53.

As shown in FIG. 5, the external lead-out terminal portions 32 and 33 are bent to form horizontal portions 32*a* and 33*a* in the pair of coil terminals 30 and 31. The vertical portions of the coil terminals 30 and 31 are also subjected to a press treatment to form the step portions 30*a* and 31*a*. However, the coil terminals 30 and 31 are continuous via connection portions 34 and 35 before being attached to the spool 21. Therefore, the coil terminals 30 and 31 are attached to the attachment board 26 of the spool 24, and then separated by cutting the connection portions 34 and 35.

Therefore, the coil terminals 30 and 31 are pressed Into the pressing grooves 27 and 28 formed in the attachment board 26 of the spool 21, respectively, thereby allowing binding portions thereof to protrude. Then, the coil 39 is wound around the winding portions 24 and 25 of the spool 21, and the leads therefrom are bound on the binding portions of the coil terminals 30 and 31 to solder.

Figure 7A:
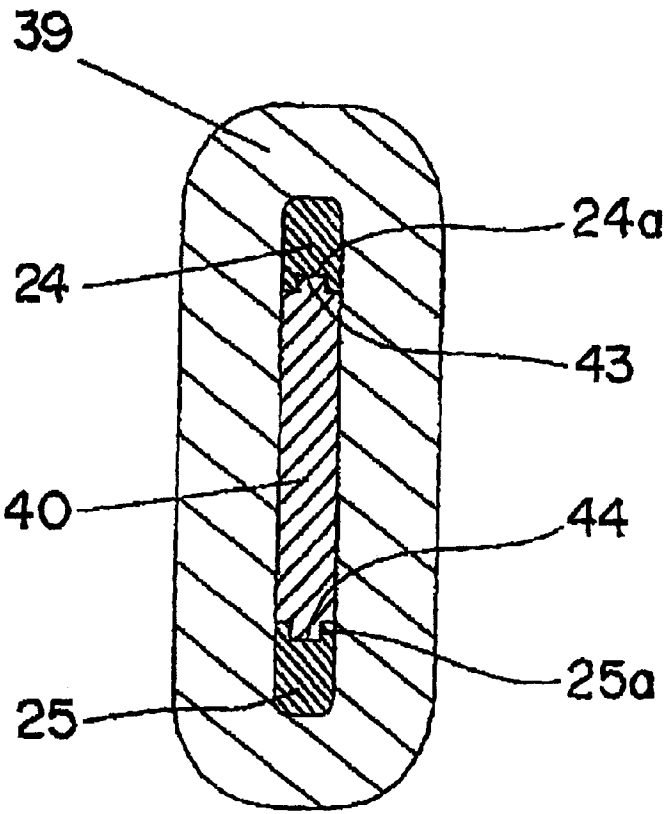
FIG. 7A in a partial sectional view of the electromagnet block in FIG. 4.
Figure 7B:
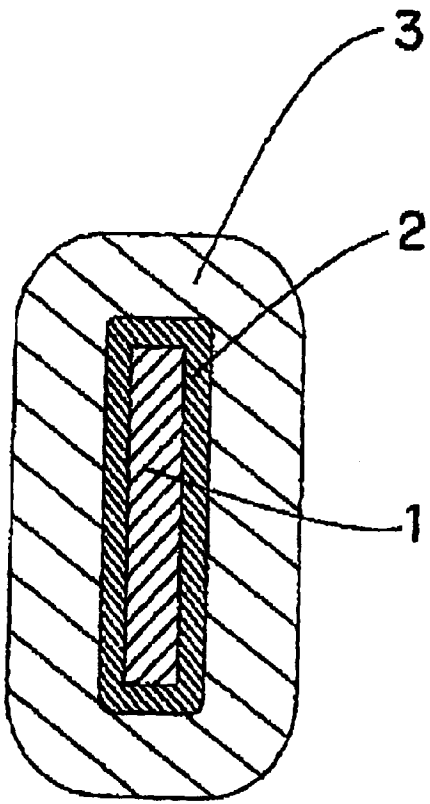
FIG. 7B is a partial sectional view of an electromagnet block according to a prior art.
Figure 8:
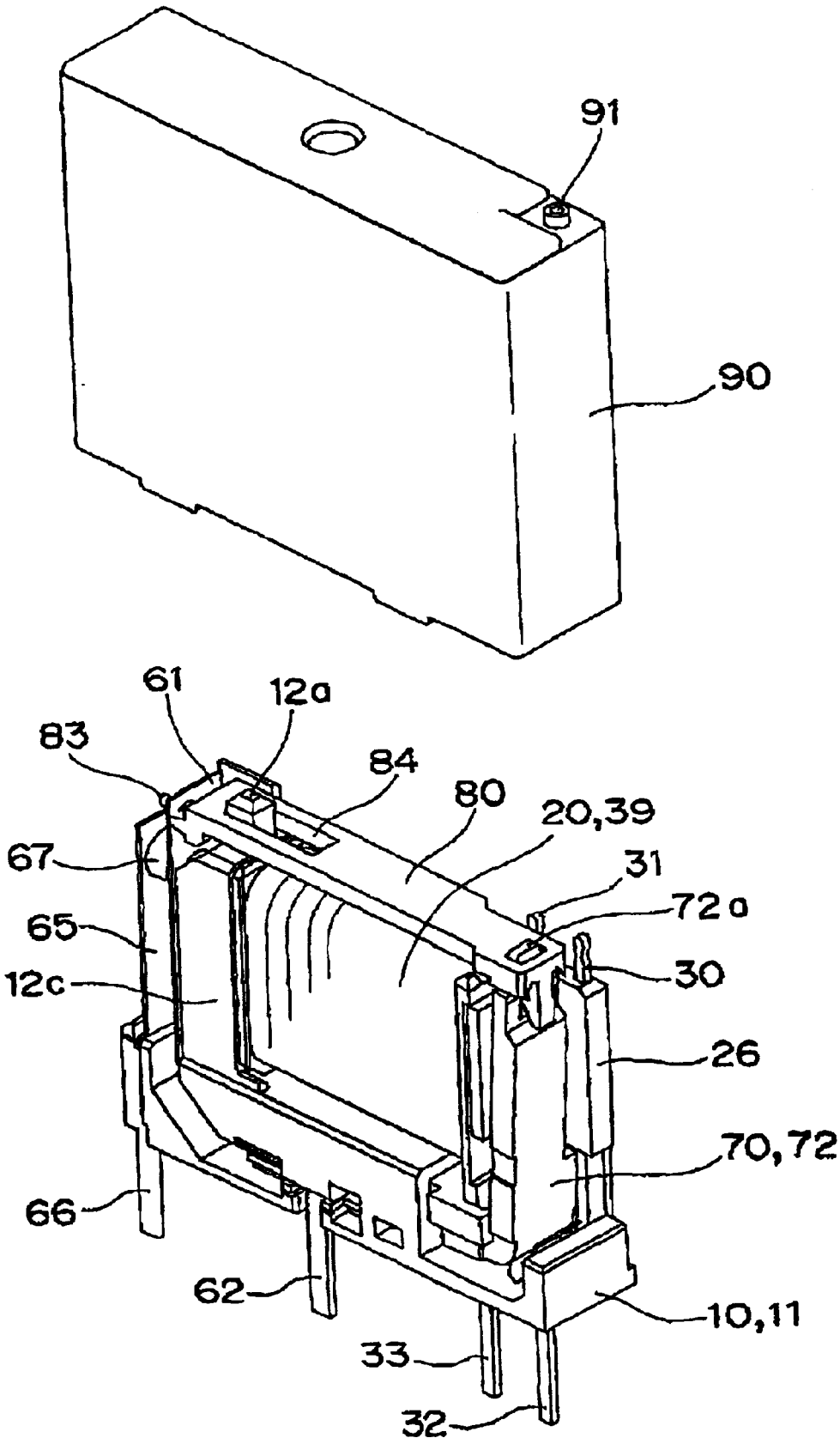
FIG. 8 is an exploded perspective view of the electromagnet block shown in FIG. 1, taken from a different angle.

Next, an end portion 42 of the iron core 40 is inserted into the angular hole 22*a* of the flange 22 of the spool 21 to fit and insert guide projections 43 and 44 of the iron core 40 into the guide grooves 24*a* and 25*a* of the winding portions 24 and 25. At this time, as shown in FIG. 7A, both side faces of the iron core 40 are flush with both side faces of the winding portions 24 and 25. Therefore, according to the present embodiment, there is an advantage in that an electromagnetic apparatus (device) can be obtained, which is thinner than that in which a coil 3 is wound around an angular cylindrical winding portion of a spool 2 into which an iron core 1 is inserted, as shown in a conventional example of FIG. 7B.

After that, the one end portion 42 of the iron core 40 protruding from the angular hole 23*a* of the flange 23 is squeeze-fitted into the squeeze hole 53 provided in the vertical portion 52 of the yoke 50. Then, the connection portions 34 and 35 of the coil terminals 30 and 31 are cut out to complete the electromagnet block 20.

The contact mechanism portion 60 is constituted by the movable contact piece 61 and the fixed contact piece 65. The movable contact piece 61 taking the form of a conductive spring member has a bent lower end portion which is squeeze-fitted to the external lead-out terminal portion 62. Further, a movable contact 63 is squeeze-fitted to an upper end portion of the movable contact piece 61 while a driving hole 61*a* is formed in the upper end portion of the movable contact 63. Furthermore, the upper end portion of the external lead-out terminal portion 62 serves as a pressing portion 62*a* which can be pressed into the pressing slit 14 of the base 10.

On the other hand, similar to the movable contact piece 61, an external lead-out terminal portion 66 is formed in a lower portion of the fixed contact piece 65, while a fixed contact 67 is squeeze-fitted to an upper end portion of the fixed contact piece 65. Furthermore, an intermediate portion of the fixed contact piece 65 is subjected to a protruding treatment, thereby forming a pressing portion 65*a*.

Note that the terminal portion 66 extends from a part of the fixed contact piece 65, and is formed by a folding treatment so as to have a sufficient thickness.

In the movable iron piece 70, a lower end portion thereof, which is made of plate-like magnetic material, is folded to form a horizontal portion 71 while a protrusion 72*a* is formed in an upper end portion of a vertical portion 72 thereof. A latching hole 73 is formed below the protrusion 72*a*. Furthermore, a notch portion 72*b* in which the attachment board 26 of the spool 21 is assembled is formed in the vertical portion 72 of the movable iron piece 70. On the other hand, a notch portion 71*a* is formed also In the horizontal portion 71 of the movable iron piece 70. Note that it is preferable that the angle between the horizontal portion 71 and the vertical portion 72 of the movable iron piece 70 is approximately 100 degrees.

The card 80 has one end portion which has a fitting hole 82 provided with a latching nail 81 and the other end portion from which a driving protrusion 83 horizontally protrudes. In addition, a guide hole 84 is formed in an intermediate portion of the card 80.

The yoke 50 of the electromagnet block 20 is inserted into the attachment hollow 13 of the base 10 from a side to attach the electromagnet block 20. At this time, since the horizontal portions 32*a* and 33*a* of the coil terminals 30 and 31 are fitted into and guided by the guide grooves 16 and 17 provided in the under face of the base 10, no shift of position occurs. Furthermore, the under face of the base 10 is flush with the horizontal portions 32*a* and 33*a*.

Then, the press portion 62*a* of the movable contact terminal 61 and the press portion 65*a* of the fixed contact piece 65 are pressed into the pressing slits 14 and 15 of the base 10, respectively. Therefore, the terminal portions 62 and 66 of the movable contact piece 61 and the fixed contact piece 65 are aligned with the contact portions 32 and 33 of the coil terminals 30 and 31 so that an in-line terminal structure can be obtained.

In addition, the movable iron piece 70 is positioned in a free end portion of the yoke 50 on the hinge spring 55 to rotatably support the movable iron piece 70. Then, the protrusion 72*a* of the movable iron piece 70 is fitted into the fitting hole 82 of the card 80 while the latching nail 81 of the card 80 is latched to the latching hole 73 of the movable iron piece 70. On the other hand, the driving protrusion 83 of the card 80 is inserted into the driving hole 61*a* of the movable contact piece 61, so that the guide protrusion 12*a* of the insulation support 12 is fitted into the guide hole 84 of the card 80. Then, the case 90 is fitted onto the base 10 to inject the sealing material on the under face of the base 10 and solidify the sealing material. At this time, since the under face of the base 10 is flush with the horizontal portions 32*a* and 33*a* of the coil terminals 30 and 3l, a small injection amount of the sealing material is sufficient. Furthermore, internal gas is removed from a gas removal hole 91 in the case 90, and then the gas removal hole 91 is sealed, thereby completing the assembly operation.

An operation of the relay formed by above-mentioned constitution will be described.

Figure 9:
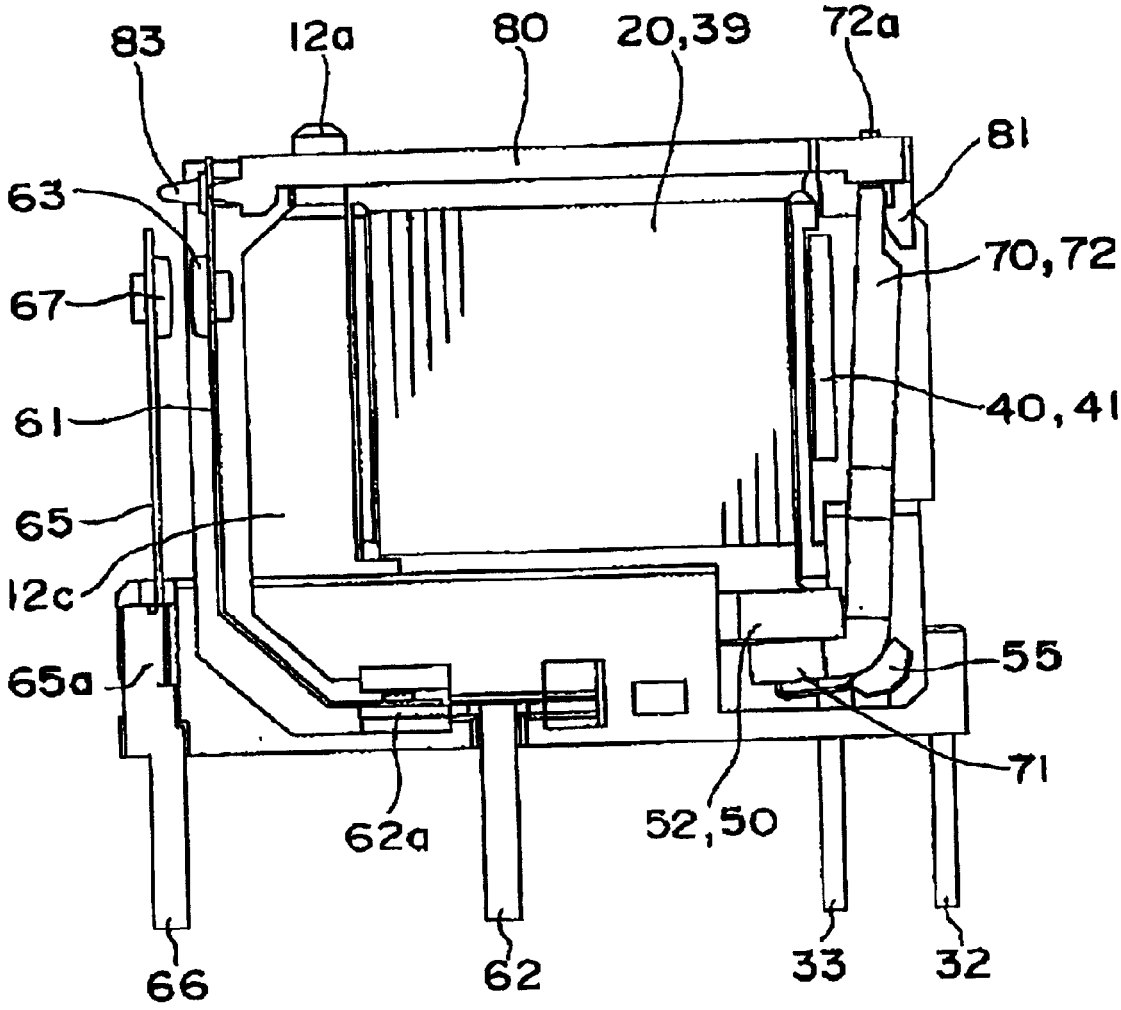
FIG. 9 is a rear view of the relay main body shown in FIG. 2.

As shown in FIG. 9, if no voltage is applied to the coil 39 of the electromagnet block 20, the card 80 is pressed by spring force of the movable contact piece 61, and the movable iron piece 70 is apart from the magnetic pole portion 41 of the iron core 40.

When the voltage is applied to the coil 39, the movable iron piece 70 is drawn to the magnetic pole portion 41 of the iron core 40. Due to this, the movable iron piece 70 rotates against the spring force of the movable contact piece 61, and presses the card 80 engaged with the upper end portion of the movable iron piece 70. As a result, the movable contact piece 61 is pressed, the movable contact 63 is comes into contact with the fixed contact 67, and then the movable iron piece 70 is attracted the magnetic pole portion 41 of the iron core 40.

Then, when the application of the voltage to the coil 39 is released, the card 80 is pressed back by the spring force of the movable contact piece 61. Due to this, after the movable iron piece 70 separates from the magnetic pole portion 41, the movable contact 63 separates from the fixed contact 67, thereby returning original state.

According to the present invention, at least one of the contact terminal and the coil terminal can be arranged at an optional position, thereby obtaining the desired terminal arrangement structure. Thus, even in use of a relay in which an electromagnetic block and a contact mechanism portion are assembled from opposites side directions of a base, it is possible to obtain an in-line terminal structure without forming a deep fitting groove in a side end face of the base. As a result, there is an effect where the base is easily formed while a sealing operation is easily performed after assembling.

Although the present invention has been described and by way of illustration and example only, it is not to be taken by way of limitation, the spirit and scope of the present invention being limited only by the terms of the appended claims.

What is claimed is:

1. A relay comprising a base, an electromagnetic block and a contact mechanism portion arranged on the top face of the base, and an insulating wall arranged between the electromagnetic block and the contact mechanism portion, the electromagnetic block and the contact mechanism portion being configured so they are capable of being assembled from opposing sides of the base, wherein at least one of an external lead-out portion of a contact terminal of the contact mechanism portion and an external lead-out portion of a coil terminal of the electromagnetic block is bent in a lateral direction so that roots of all of said external lead-out portions are arranged in a line along an edge of an under face of the base and the laterally-bent portion of the external lead-out portion lies in a same plane as the under face of the base.

2. The relay according to claim 1, wherein the electromagnetic block comprises an iron core, one side of which is bent to form a magnetic pole portion, the relay further comprising a coil, a binding portion of the coil being arranged so as to be adjacent to the magnetic pole portion.

3. The relay according to claim 1, wherein the under side of the base comprises guide grooves into which the bent external lead-out portions can fit.

4. The relay according to claim 1, wherein a step portion is formed in the coil terminal so that a portion of the coil terminal is arranged on the inside of the base.

* * * * *